US005145140A

United States Patent [19]

Caston et al.

[11] Patent Number: 5,145,140

[45] Date of Patent: Sep. 8, 1992

[54] GOLF SCORE CARD SUPPORT BRACKET

[76] Inventors: Jackie L. Caston, 10420 Cletus Dr., Baton Rouge, La. 70815; Tracy L. Simoneaux, 21 Park St., Ventress, La. 70783

[21] Appl. No.: 723,775

[22] Filed: Jul. 1, 1991

[51] Int. Cl.[5] ..... A47B 97/04

[52] U.S. Cl. ..... 248/447.2; 248/205.2; 248/205.3

[58] Field of Search ..... 248/447.2, 231.8, 205.2, 248/205.3, 316.7; 224/901, 918, 277; 40/611, 617

[56] References Cited

U.S. PATENT DOCUMENTS

| | | | |
|---|---|---|---|
| 1,615,959 | 2/1927 | Slavik | 248/447.2 X |
| 3,866,873 | 2/1975 | Bohli | 248/205.3 X |
| 4,157,152 | 6/1979 | Blastic | 24/11 P X |
| 4,274,567 | 6/1981 | Sawyer | 224/277 X |
| 4,449,310 | 5/1984 | Kline | 224/918 |
| 4,746,045 | 5/1988 | Schweim | 40/661 X |
| 4,830,248 | 5/1989 | Pommenville | 224/918 X |
| 4,953,770 | 9/1990 | Bond, Sr. | 224/901 X |
| 5,038,985 | 8/1991 | Chapin | 224/252 |

*Primary Examiner*—Ramon O. Ramirez
*Attorney, Agent, or Firm*—Leon Gilden

[57] ABSTRACT

A support bracket defined by a generally "U" shaped spring clip member is mounted to an upper edge of an associated golf bag to secure a score card between a forward leg of the bracket and an outer surface of the golf bag. A modification of the invention includes attending leg members pivoted outwardly to provide support and integrity to a score card mounted within the bracket structure. The bracket forward leg includes a lower terminal end defining an outwardly extending flange projecting forwardly of a forward planer surface of the outer leg to provide an underlying support for an associated score card mounted thereon.

2 Claims, 4 Drawing Sheets

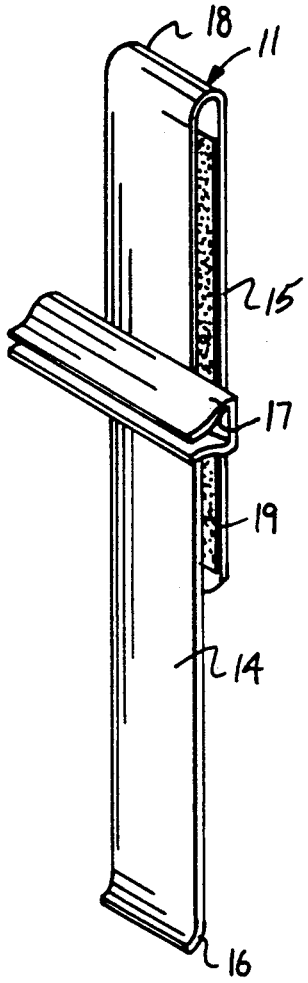
Fig 1
Fig 2
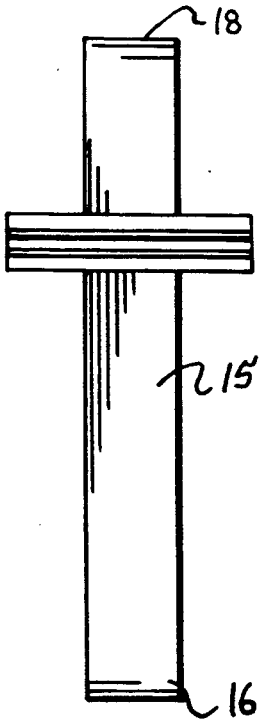
Fig 3
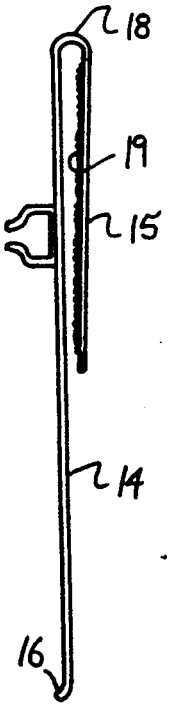

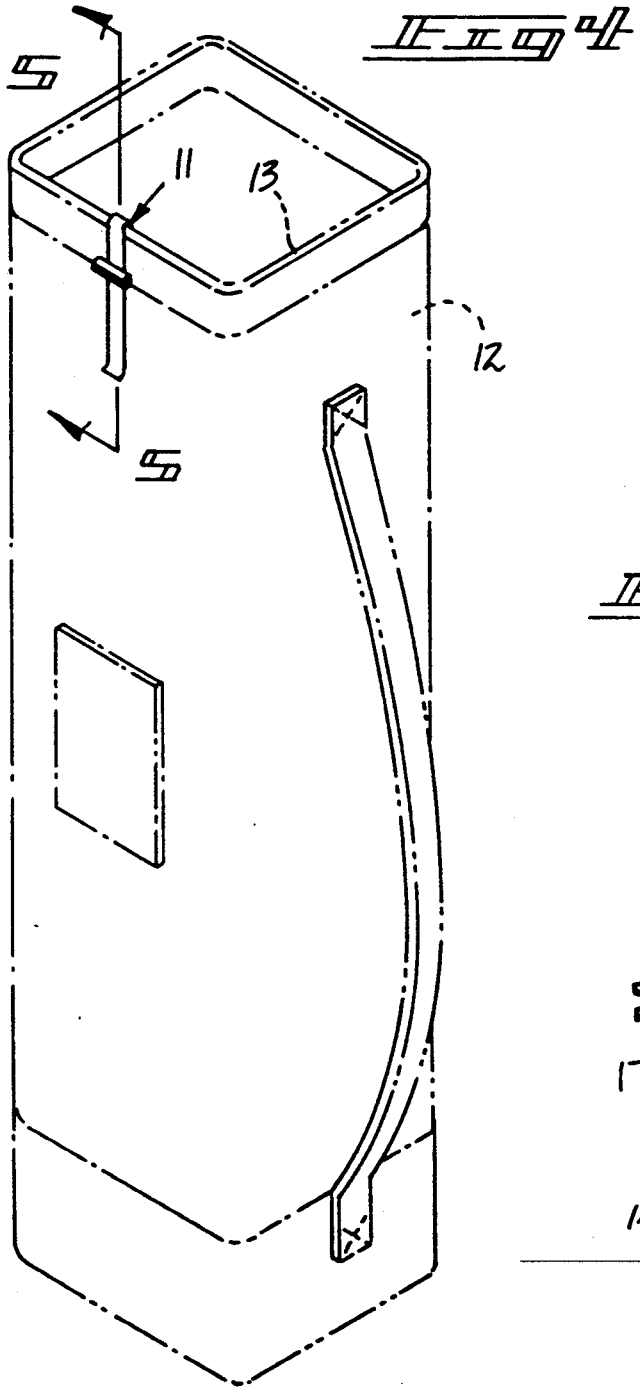
Fig 4
Fig 5
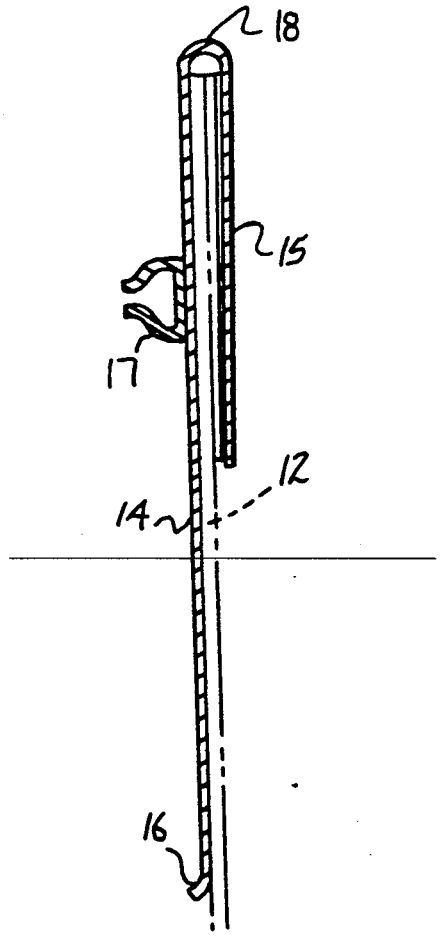

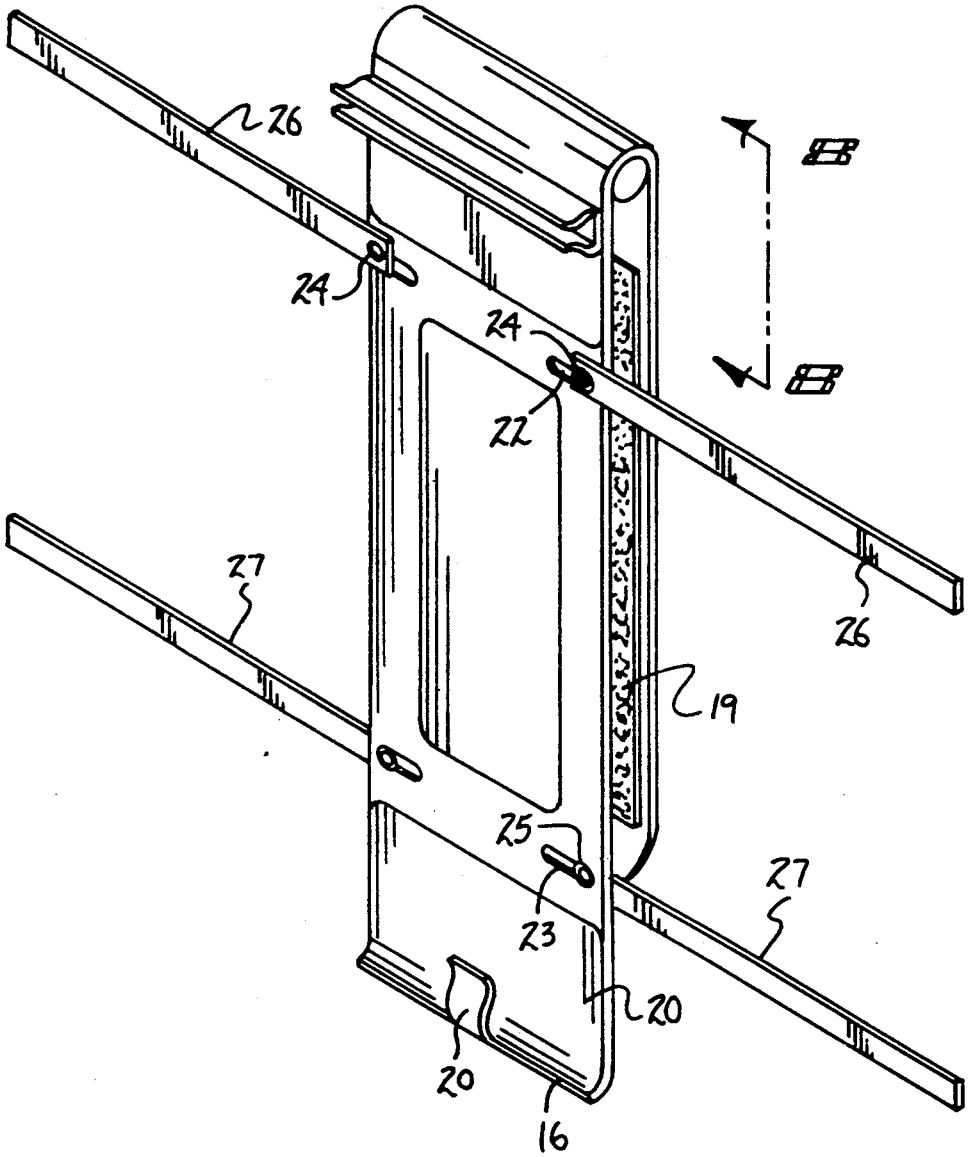
Fig 7
Fig 8
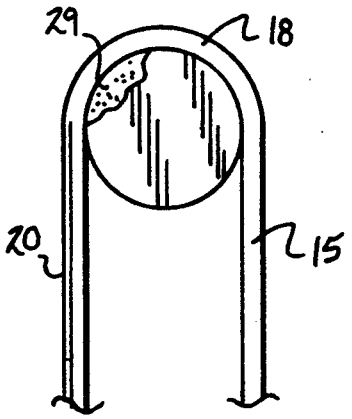

GOLF SCORE CARD SUPPORT BRACKET

BACKGROUND OF THE INVENTION

1. Field of the Invention

The field of invention relates to golf apparatus, and more particularly pertains to a new and improved golf score card support bracket wherein the same is arranged for mounting a score card relative to a golfing bag.

2. Description of the Prior Art

The mounting and positioning of golf score cards during play of an associated golf game is at times a tedious awkward procedure as to where and how an individual may position the score for it to be readily available to accept indicia relative to a scoring procedure relative to a golf game. Score cards may be supported in an individual's pocket and the like by or subject to wrinkling and deformation. Prior art golf score card apparatus is exemplified in U.S. Pat. No. 4,361,934 to Darnell wherein a golf score includes a clip member that is pivotally mounted to a golf bag for suspending a plate, wherein the plate removably mounts a pencil thereon.

U.S. Pat. No. 4,830,248 to Pommenville sets forth an accessory bracket mounted to an upper edge of a golf bag for securing various components such as golfing tees and the like therewithin.

U.S. Pat. No. 4,746,045 to Schweim sets forth a golf score card holder formed of a rigid transparent plastic material defining upper and lower "U"shaped support bracket structure.

U.S. Pat. No. 4,475,676 to Smith sets forth a generally "S" shaped clip for supporting various golfing components thereon, such as golf tees.

U.S. Pat. No. 4,157,152 to Blastic sets forth a golf score card wherein a generally planar surface mounts an overlying clip structure to secure a golf score card thereto.

As such, it may be appreciated that there continues to be a need for a new and improved golf score card support bracket as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of golf apparatus now present in the prior art, the present invention provides a golf score card support bracket wherein the same defines a generally "U" shaped clip arranged for securement to an upper edge portion of a golf bag. As, such, the general purpose of the present invention, which will be described subsequently in greater detail, is to provide a new and improved golf score support bracket which has all the advantages of the prior art golf apparatus and none of the disadvantages.

To attain this, the present invention provides a support bracket defined by a generally "U" shaped spring clip member mounted to an upper edge of an associated golf bag to secure a score card between a forward leg of the bracket and an outer surface of the golf bag. A modification of the invention includes attending leg members pivoted outwardly to provide support and integrity to a score card mounted within the bracket structure. The bracket forward leg includes a lower terminal end defining an outwardly extending flange projecting forwardly of a forward planar surface of the outer leg to provide an underlying support for an associated score card mounted thereon.

My invention resides not in any one these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of the other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public gemerally, and especially the scientists, engineers and practitioners in the art who are not familar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved golf score card support bracket which has all the advantages of the prior art golf apparatus and none of the disadvantages.

It is another object of the present invention to provide a new and improved golf score card support bracket which may be easily and efficiently manufactured and marketed.

It is a further object of the present invention to provide a new and improved golf score card support bracket which is of a durable and reliable construction.

An even further object of the present invention is to provide a new and improved golf score card support bracket which is susceptible of a low cost of manufacture with regard to both materials and labor, and which accordingly is then susceptible of low prices of sale to the consuming public, thereby making such golf score support brackets economically available to the buying public.

Still yet another object of the present invention is to provide a new and improved golf score card support bracket which provides in the apparatuses and methods of the prior art some of the advantages thereof, while simultaneously overcomming some of the disadvantages normally associated therewith.

These together with objects of the invention, along with the various features of novelty which characterize the invention, are pointed out with particularity in the claims annexed to and forming a part of this disclosure. For a better understanding of the invention, its, operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is an isometric illustration of the instant invention.

FIG. 2 is an orthographic frontal view, taken in elevation, of the instant invention.

Fig. 3 is an orthographic side view, taken in elevation, of the instant invention.

FIG. 4 is an isometric illustration of the invention mounted to an associated golf bag.

FIG. 5 is an orthographic view, taken along the lines 5—5 of FIG. 4 in the direction indicated by the arrows.

FIG. 7 is an isometric illustration of the modified invention with the support leg extended relative thereto.

FIG. 8 is an orthographic view, taken along the lines 8—8 of FIG. 7 in the direction indicated by the arrows.

DESCRIPTION OF THE PREFERRED EMBODIMENT

Figure 5A:
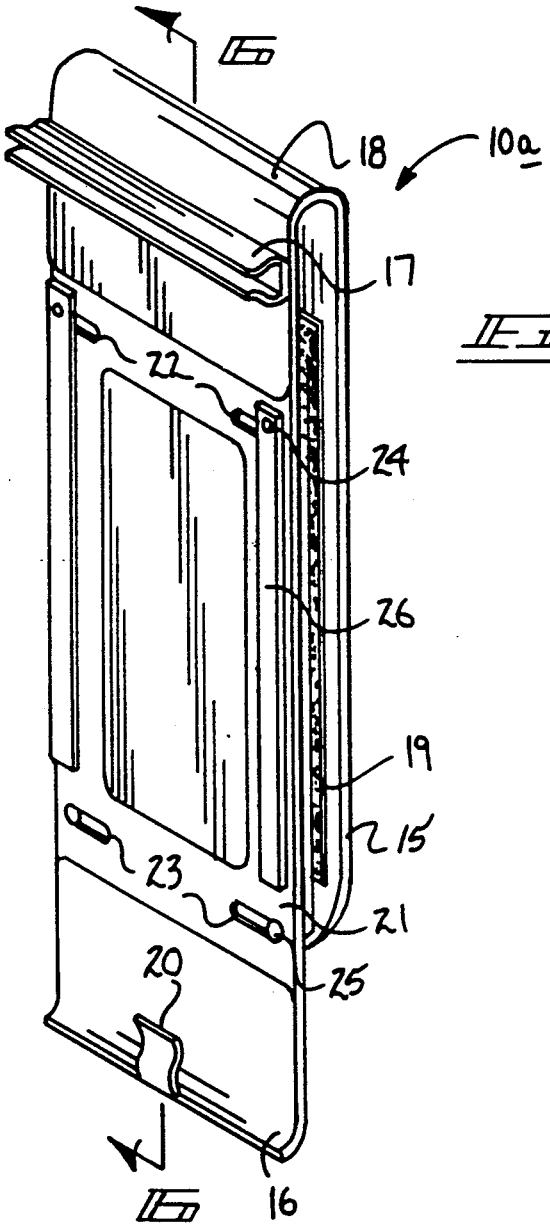
FIG. 5*a* is an isometric illustration of a modification of the invention.
Figure 6:
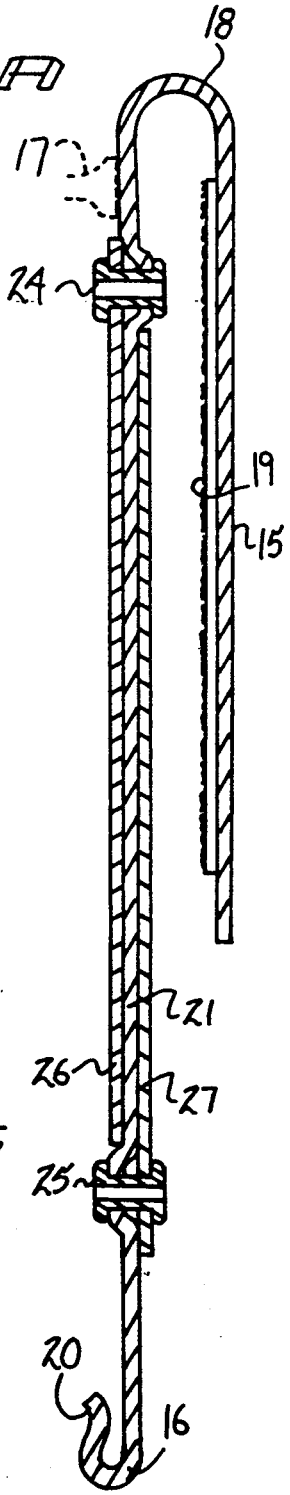
FIG. 6 is an orthographic view, taken along the lines 6—6 of FIG. 5*a* in the direction indicated by the arrows.

With reference now to the drawings, and particular to FIGS. 1 to 8 thereof, a new and improved golf score card support bracket embodying the principles and concepts of the present invention and generally designated by the reference numerals 10 and 10*a* will be described.

More specifically, the golf score card support bracket 10 of the instant invention essentially comprises a generally "U" shaped spring clip member 11 defined by spaced legs that are biased towards one another, wherein the legs are each of a generally planar configuration for securement to a golf bag wall 12 to an upper terminal edge 13 thereof.

The spring member 11 includes a planar front leg plate 14 defined by a first length spaced from a planar rear leg plate 15 defined by a second length less than first length that is received interiorly of the associated golf bag wall 12, wherein the front and rear plates 14 and 15 are secured together by an arcuate junction web 18. A lower terminal end of the front leg plate 14 includes a projecting flange 16 projecting downwardly and forwardly of a forward surface of the front leg plate 14 for ease of mounting to an associated golf bag, wherein a "U" shaped spring pencil clip 17 is integrally and orthogonally mounted to a forward surface of the front leg plate 14 for securing a pencil therewithin. A hook and loop fastener patch 19 is mounted to a forward surface of the rear leg plate 15 to enhance securement with the interior surface of the golf bag wall 12.

A modified bracket 10*a*, as illustrated in FIGS. 5–8, includes a lower flange projecting leg 20 that is positioned medially of the projecting flange 16 and extends upwardly therefrom in overlying relationship relative to a modified front leg plate 21 and forward surface thereof to receive a score card member thereon if desired. Additionally, a plurality of upper slots 22 that are aligned relative to one another and are positioned adjacent opposed side edges of the front leg plate 21 are spaced parallel to and above a plurality of lower slots 23. The lower slots 23 and the upper slots 22 include respective lower and upper pivot pins 25 and 24 respectively, with each of the pins pivotally mounting a support leg defined by lower and upper respective support legs 27 and 26. The support legs may be rotated relative to the projecting leg 20 to provide for additional support to a score card member that is positioned either forwardly or rearwardly of the front leg plate 21. Further, as illustrated in FIGS. 7 and 8, a cylindrical capsule 28 is mounted to an interior surface of the junction web 18 between the front and rear leg plates 21 and 15 respectively containing an adhesive fluid 29 therewithin. In this manner, projection of the bracket 10*a* downwardly impacts the capsule 28 with the golf bag wall upper terminal edge 13 to provide permanent securement of the bracket to the golf bag if desired.

As to the manner of usage and operation of the instant invention, the same should be apparent from above the disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A golf score card support bracket, comprising, a "U" shaped spring clip member, the "U" shaped spring clip member including a front planar leg plate spaced from a rear planar leg plate, wherein the front leg plate and the rear leg plate are joined together by a junction web, and the front leg plate includes a lower projecting flange extending below and forwardly of the front leg plate, and the front leg plate is defined by a first length and the rear leg plate is defined by a second length, wherein the first length is greater than the second length, wherein the second length is arranged to accommodate and secure a score card member between the front leg plate and an associated golf bag wall, and the rear leg plate includes a hook and loop fastener patch surface mounted fixedly to the rear leg plate in confrontation to the front leg plate, and the lower projecting flange includes a lower flange projecting leg positioned above the front leg plate in a spaced relationship extending integrally and orthogonally relative to the projecting flange, and a further "U" shaped spring pencil clip mounted fixedly and orthogonally relative to the front leg plate adjacent the arcuate junction web, and a plurality of upper slots, wherein the upper slots are aligned relative to one another and are orthogonally aligned relative to opposed side edges of the front leg plate, and a plurality of lower slots, wherein the lower slots are aligned relative to one another and are positioned orthogonally relative to opposed side edges of the front leg and are arranged in a parallel spaced relationship relative to the upper slots spaced apart a predetermined spacing, and each slot includes a pivot pin, and each pivot pin includes a support leg mounted to the pivot pin for pivotally mounting each support leg relative to the front leg plate, and each support leg is defined by a predetermined length less than the predetermined spacing between the lower slots and the upper slots.

2. An apparatus as set forth in claim 1 including a cylindrical capsule mounted to the arcuate junction web between the front leg plate and the rear leg plate, wherein the cylindrical capsule includes an adhesive fluid contained therewithin, wherein projection of the cylindrical capsule onto an upper terminal edge of the golf bag wall effects permanent securement of the arcuate junction web relative to the golf bag wall.

* * * * *